US009755369B2

(12) United States Patent
Huang et al.

(10) Patent No.: US 9,755,369 B2
(45) Date of Patent: Sep. 5, 2017

(54) CABLE CONNECTOR ASSEMBLY

(71) Applicant: FOXCONN INTERCONNECT TECHNOLOGY LIMITED, Grand Cayman, KY (US)

(72) Inventors: Shuai-Hui Huang, Kunshan (CN); Ru-Yang Guo, Kunshan (CN); Qing-Man Zhu, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/080,612

(22) Filed: Mar. 25, 2016

(65) Prior Publication Data

US 2016/0285207 A1 Sep. 29, 2016

(30) Foreign Application Priority Data

Mar. 27, 2015 (CN) ..... 2015 2 0177552 U

(51) Int. Cl.

| | |
|---|---|
| ***H01R 9/03*** | (2006.01) |
| ***H01R 13/6581*** | (2011.01) |
| ***H01R 12/53*** | (2011.01) |
| *H01R 24/28* | (2011.01) |
| *H01R 24/62* | (2011.01) |

(52) U.S. Cl.

CPC ..... *H01R 13/6581* (2013.01); *H01R 12/53* (2013.01); *H01R 24/28* (2013.01); *H01R 24/62* (2013.01)

(58) Field of Classification Search

CPC ..... H01R 13/6581

USPC ..... 439/607.55, 607.41, 101, 108, 449, 660

See application file for complete search history.

(56) References Cited

U.S. PATENT DOCUMENTS

| | | | | |
|---|---|---|---|---|
| 5,820,412 | A * | 10/1998 | Koegel | H01R 13/6593 439/607.51 |
| 6,165,017 | A * | 12/2000 | Kuo | H01R 13/6275 439/357 |
| 6,607,397 | B1 * | 8/2003 | Zhang | H01R 13/193 439/357 |
| 6,988,908 | B2 * | 1/2006 | Zhang | H01R 13/6275 439/358 |
| 7,494,384 | B2 * | 2/2009 | Friedhof | H01R 13/621 439/472 |
| 7,540,773 | B2 * | 6/2009 | Ko | H01R 13/5808 439/581 |
| 7,544,084 | B1 * | 6/2009 | Dutton | G02B 6/387 439/465 |

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A cable connector assembly (100) comprises a cable (300) and a connector (100) connecting to said cable (300). The connector (100) includes a contact module (1) and a shell (2) installed at the outside of the contact module (1), the shell (2) including a base (21) extending in a transverse direction and a pair of side covers (22,23) assembled to two sides of the base (21) in the transverse direction. Each of the base (21) and side covers (22,23) includes an insulating layer (211,221,231) and a shield layer (212,222,232), the shield layers (212,222,232) of the base (21) and the side covers (22,23) form a shield space surrounding the contact module (1).

18 Claims, 14 Drawing Sheets

(56) References Cited

U.S. PATENT DOCUMENTS

| | | | | |
|---|---|---|---|---|
| 7,651,375 | B2 * | 1/2010 | Zhu | H01R 13/6658 439/607.41 |
| 7,878,855 | B2 * | 2/2011 | Li | H01R 13/65802 439/607.04 |
| 8,562,378 | B2 * | 10/2013 | Su | H01R 13/502 439/607.55 |
| 9,257,800 | B2 * | 2/2016 | Huang | H01R 12/61 |
| 9,281,612 | B2 * | 3/2016 | Gao | H01R 9/03 |
| 2008/0280495 | A1 * | 11/2008 | Ko | H01R 43/0256 439/638 |
| 2009/0156059 | A1 * | 6/2009 | Zhu | H01R 13/6658 439/607.41 |
| 2010/0151732 | A1 * | 6/2010 | Xu | H01R 13/506 439/607.45 |
| 2013/0337692 | A1 * | 12/2013 | Yu | H01R 4/023 439/626 |
| 2015/0214654 | A1 * | 7/2015 | Huang | H01R 12/61 439/39 |

* cited by examiner

CABLE CONNECTOR ASSEMBLY

BACKGROUND OF THE INVENTION

1. Field of the Invention

The present invention relates to a cable connector assembly, particularly to a cable connector assembly improving the shielding performance.

2. Description of Related Art

U.S. Pat. No. 7,651,375 and Publication No. 20100151732 respectively disclose a cable connector assembly, which has a internal shielding structure, the former made up of three metal portions and the latter made up of two metal shells engaging on the printed circuit board respectively forming a shielding space enclosing the printed circuit board. The common ground is trying to provide the shielding space as close as possible to get better shielding effect. As is known to all, the shielding structure of the connector has a great effect on the stability and transmission rate of signal, the shielding performance of connector becomes particularly important when transporting high-rate signal.

Hence, a new and simple cable connector assembly is desired.

SUMMARY OF THE INVENTION

According to one aspect of the present invention, a cable connector assembly comprises a cable and a connector connecting to the cable. The connector includes a contact module and a shell installed at the outside of the contact module, the shell including a base extending in a transverse direction and a pair of side covers assembled to two sides of the base in the transverse direction. Each of the base and side covers includes an insulating layer and a shield layer, the shield layer of the base and the side covers form a shield space surrounding the contact module.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
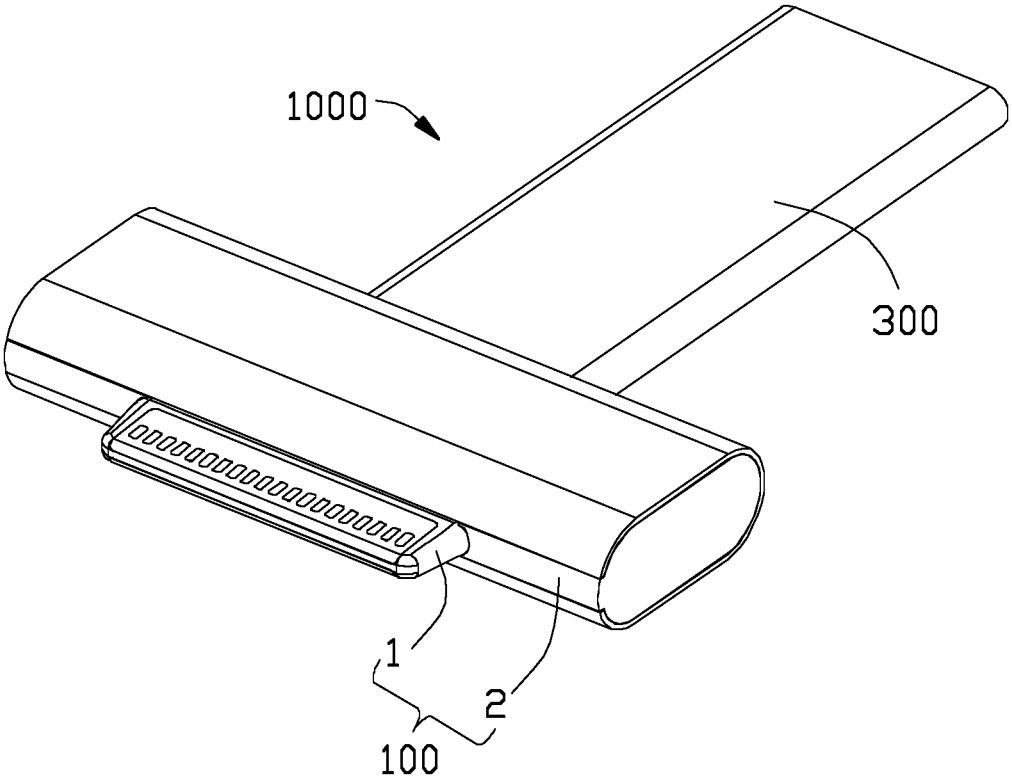
FIG. 1 is a perspective view of a cable connector assembly.
Figure 2:
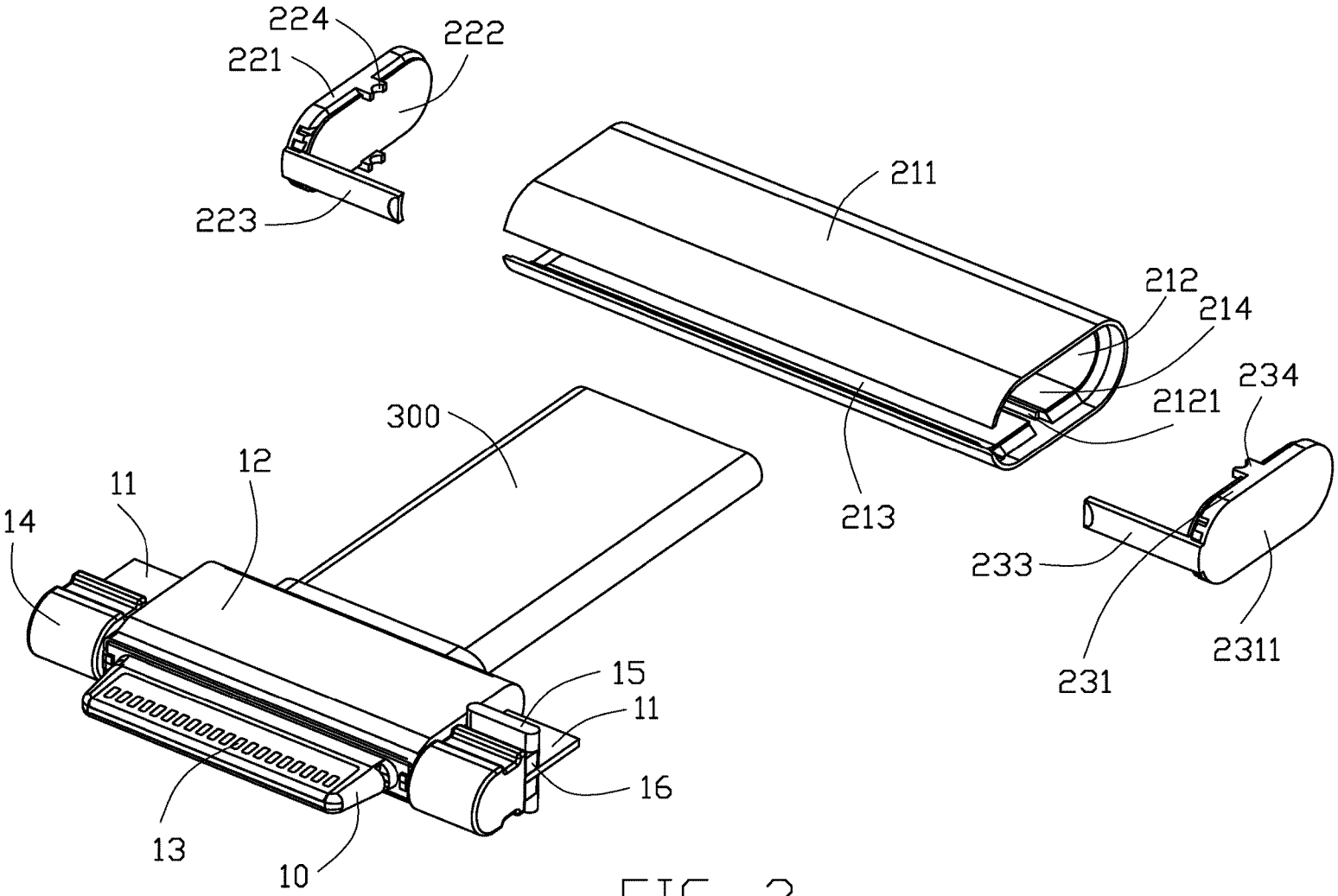
FIG. 2 is a perspective, partly exploded perspective view of the cable connector assembly show in FIG. 1.
Figure 3:
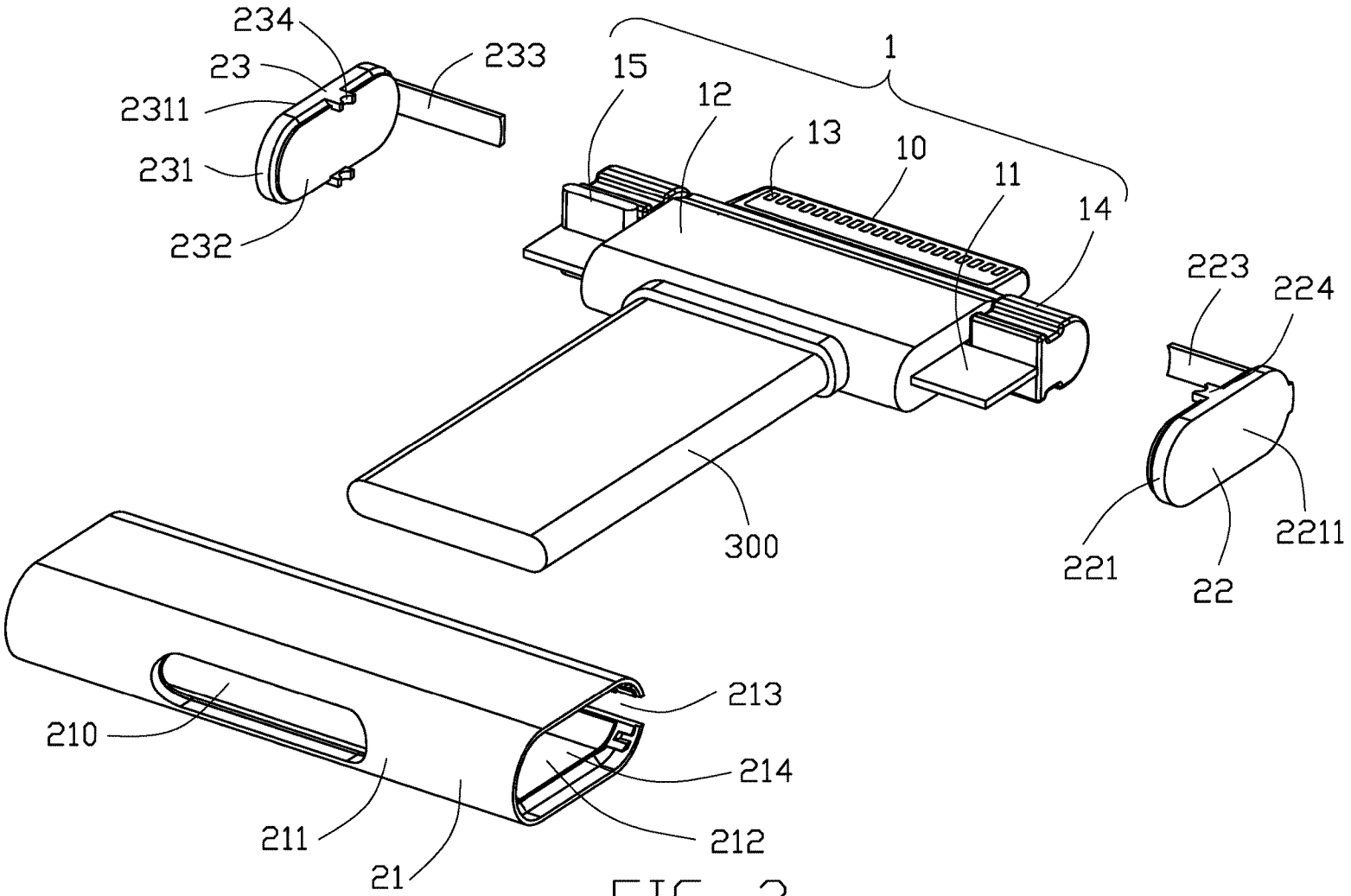
FIG. 3 is another perspective view of the cable connector assembly of FIG. 2.
Figure 4:
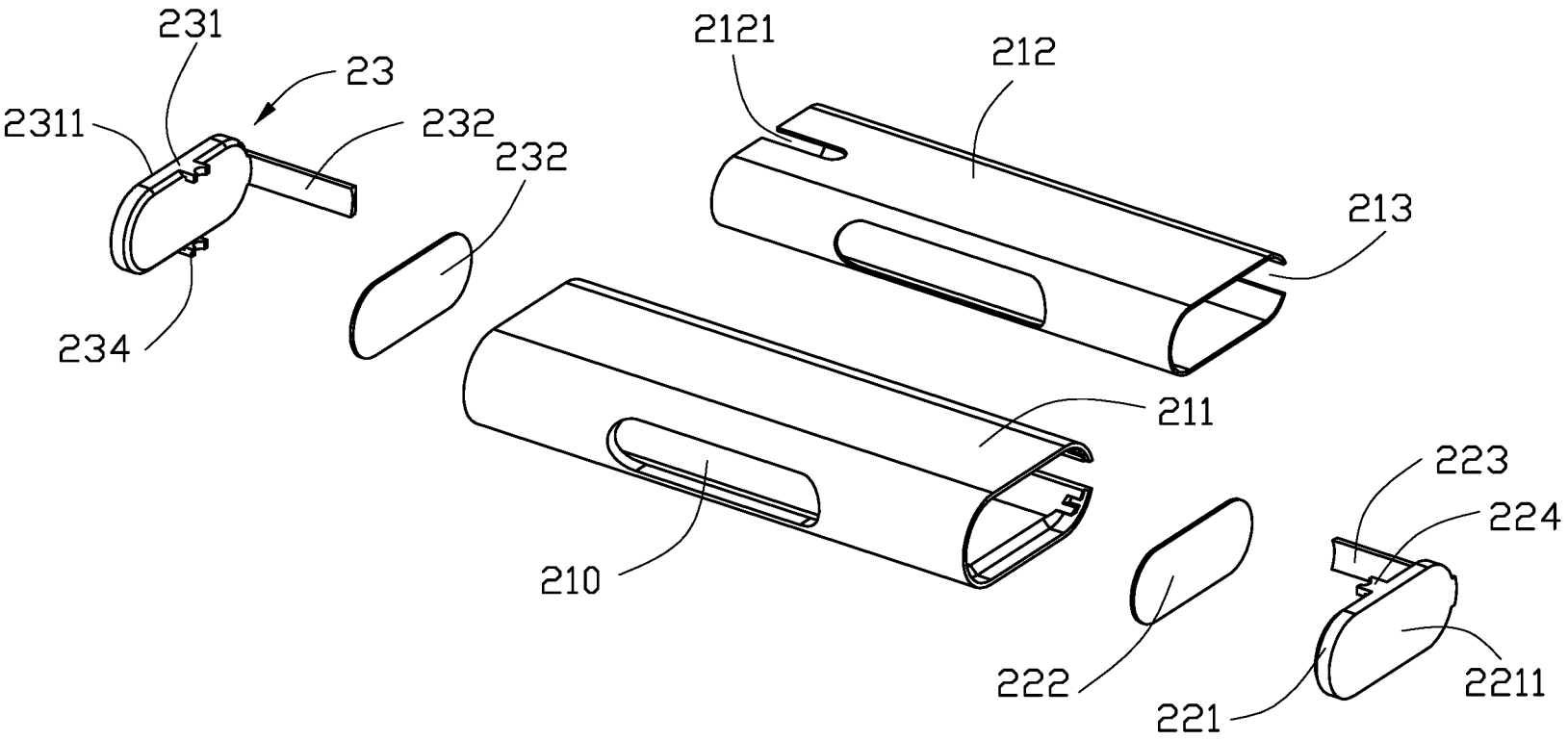
FIG. 4 is a further exploded perspective view of the shell of FIG. 1.

Referring to FIGS. 1-4, the instant invention discloses a cable connector assembly 1000 comprising a cable 300 and a connector 100 connecting to the cable 300. The connector 100 includes a contact module 1 and a shell 2 installed at the outside of the contact module 1. The shell 2 defines an opening 213 facing forwardly and a hole 210 facing backwardly for the cable 300 passing through, the elasticity opening 213 running through said base 21 in said transverse direction for said contact module 1 forwardly extending through and that also could enclose the thickness of contact module 1 from the initial size of the first to the second. The hole 210 allowing the cable 300 to go through, and when the end of the cable 300 connecting with the contact module 1, the opening 213 open to the second size to make the contact module 1 enter into the shell 2 then reset to the first size.

The contact module 1 includes a printed circuit board 11 positioned horizontally, a plurality of conductive contacts 13 installed in the front of the printed circuit board 11 and a tongue 10 enclosing the front of the contact 13 and forwardly extending out of the opening 213, the tongue 10 formed out of the contact 13 within the present embodiment; Obviously, it can be inserted into the tongue 10 formed singularly from backward to the forward, but whatever the manners of fixing the tongue 10 and the contact 13, the contact 13 is required to expose on the tongue 10 for contacting with the docking connector (not shown). The contact module 1 also includes a pair of supporting portions 14, preferably of magnetic material, fixed on the printed circuit board 11, a filling portion 12 made from insulative material enclosing at the location for protection where the cable 300 connects with the printed circuit board 11, a luminous element 16 mounted to the printed circuit board 11 and light guiding member 15 located beside said luminous element 16. The supporting portions 14 are located at two sides of the contact module 1 for internally sustaining the shell 2.

Figure 5:
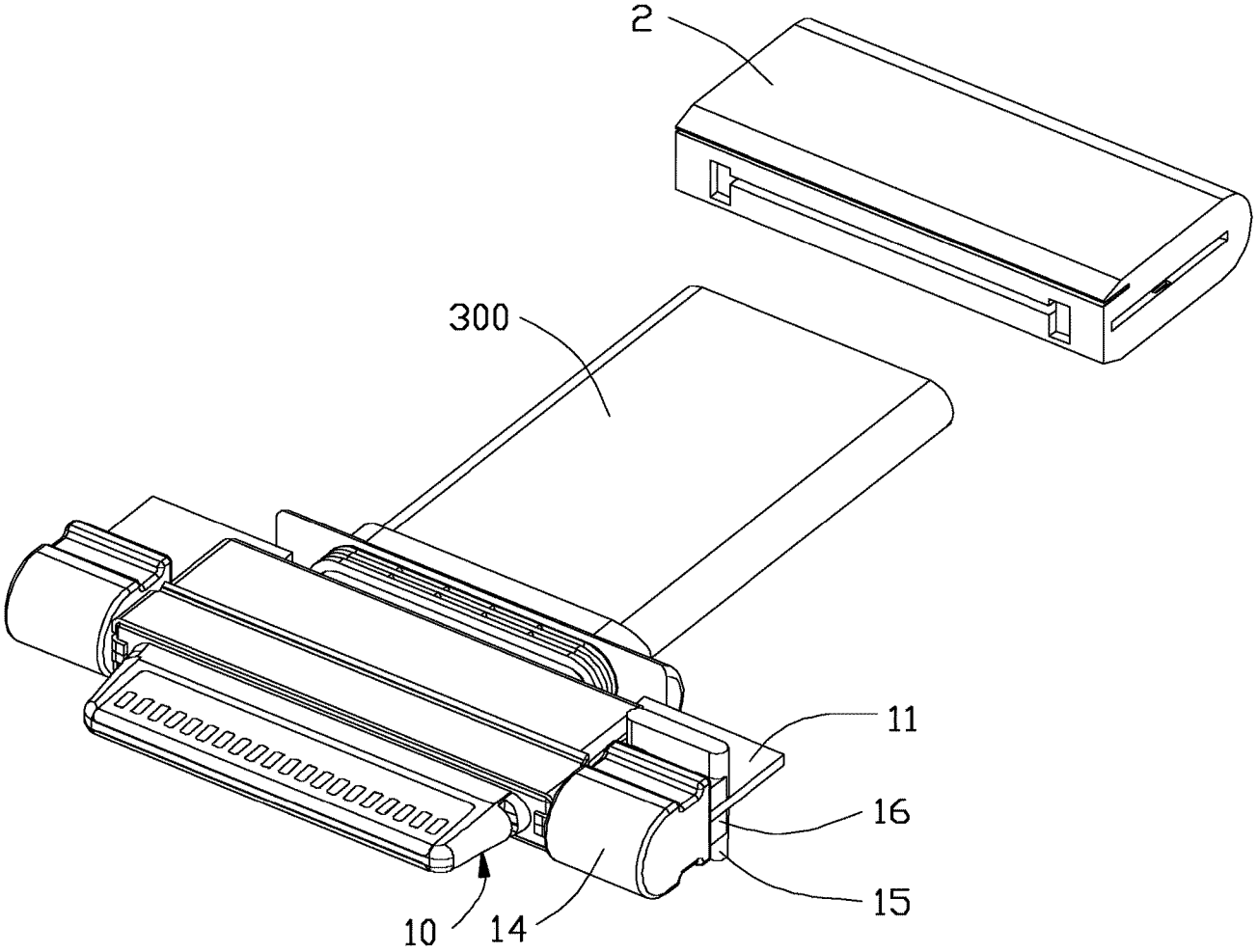
FIG. 5 is a further exploded perspective view of the contact module with the associated cable of FIG. 3.
Figure 6:
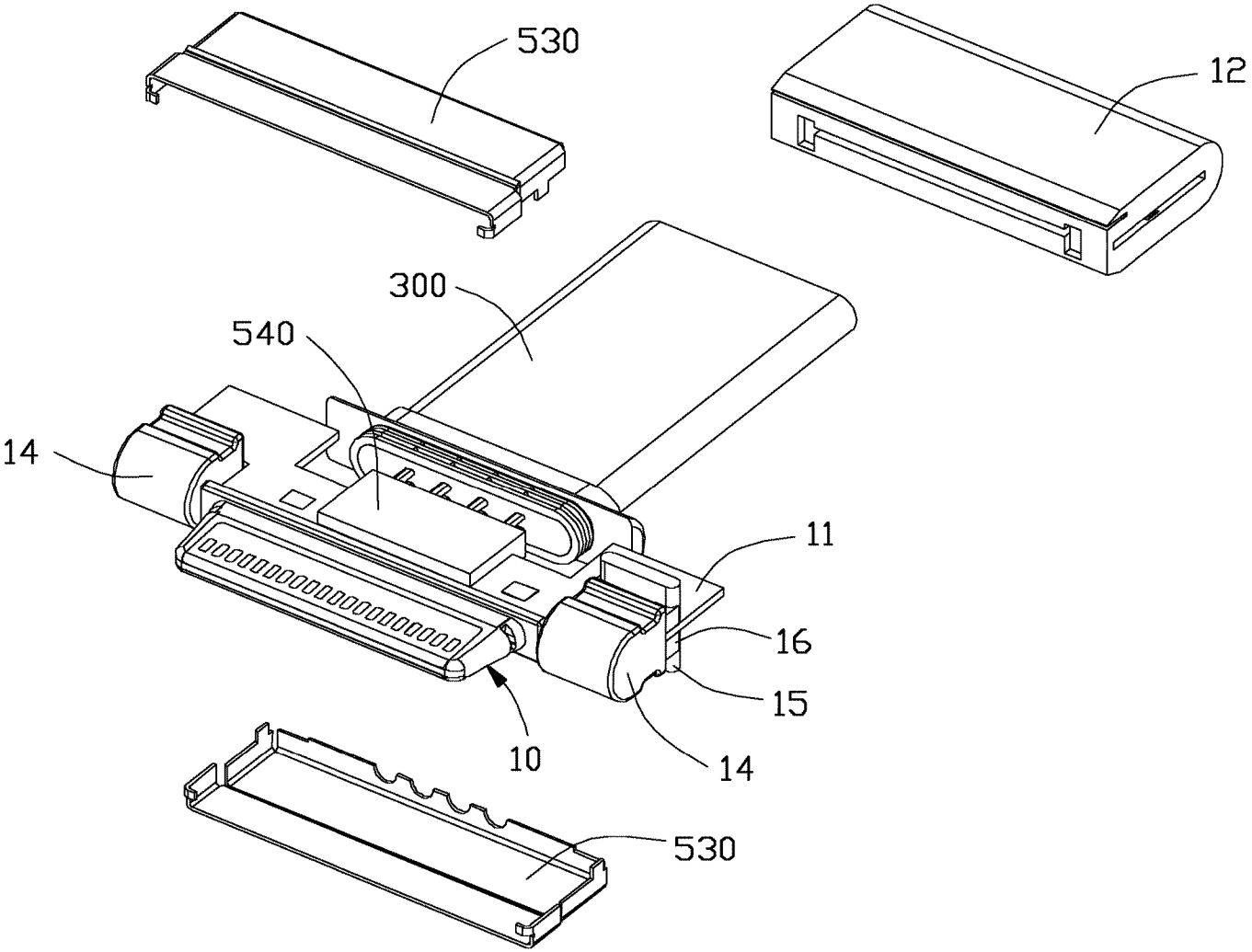
FIG. 6 is a further exploded perspective view of the contact module of FIG. 5.
Figure 7:
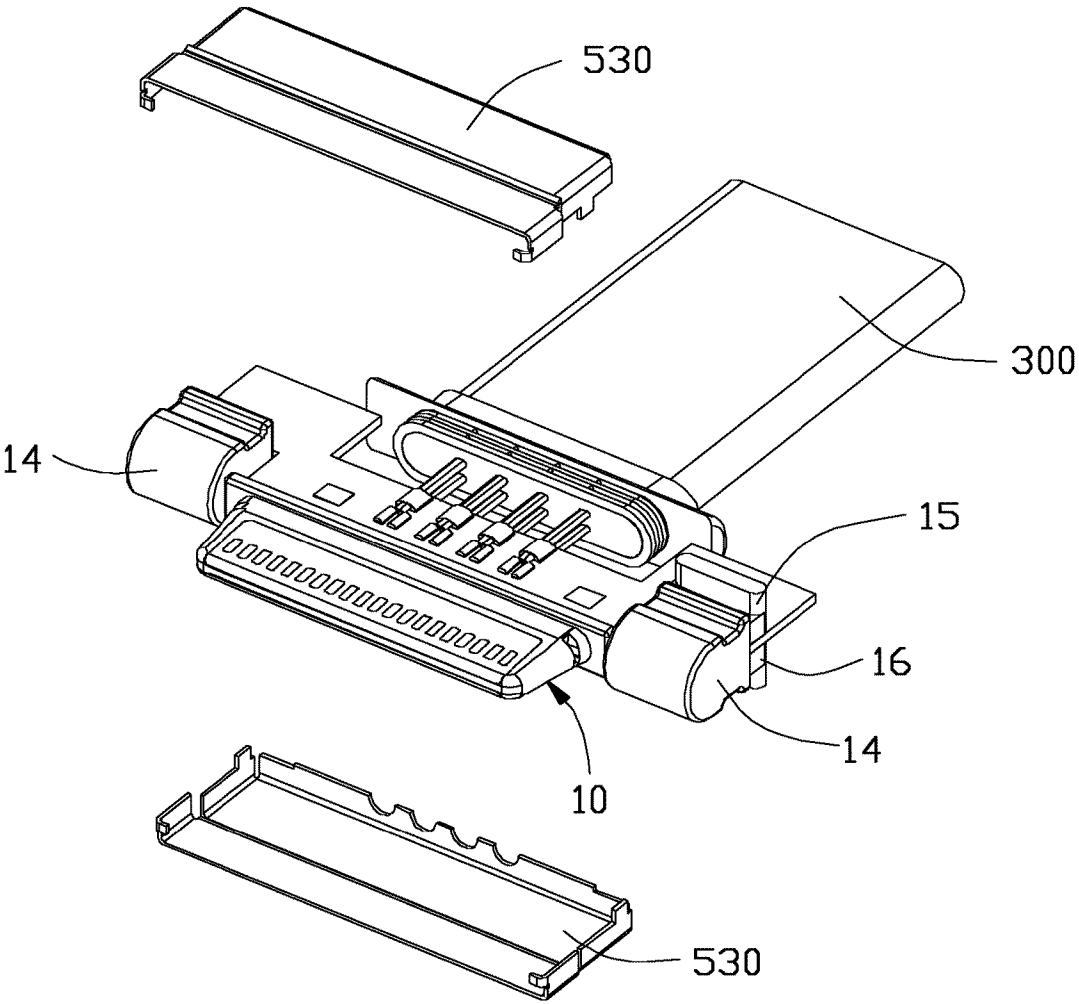
FIG. 7 is further exploded perspective view of the contact module of FIG. 6.
Figure 8:
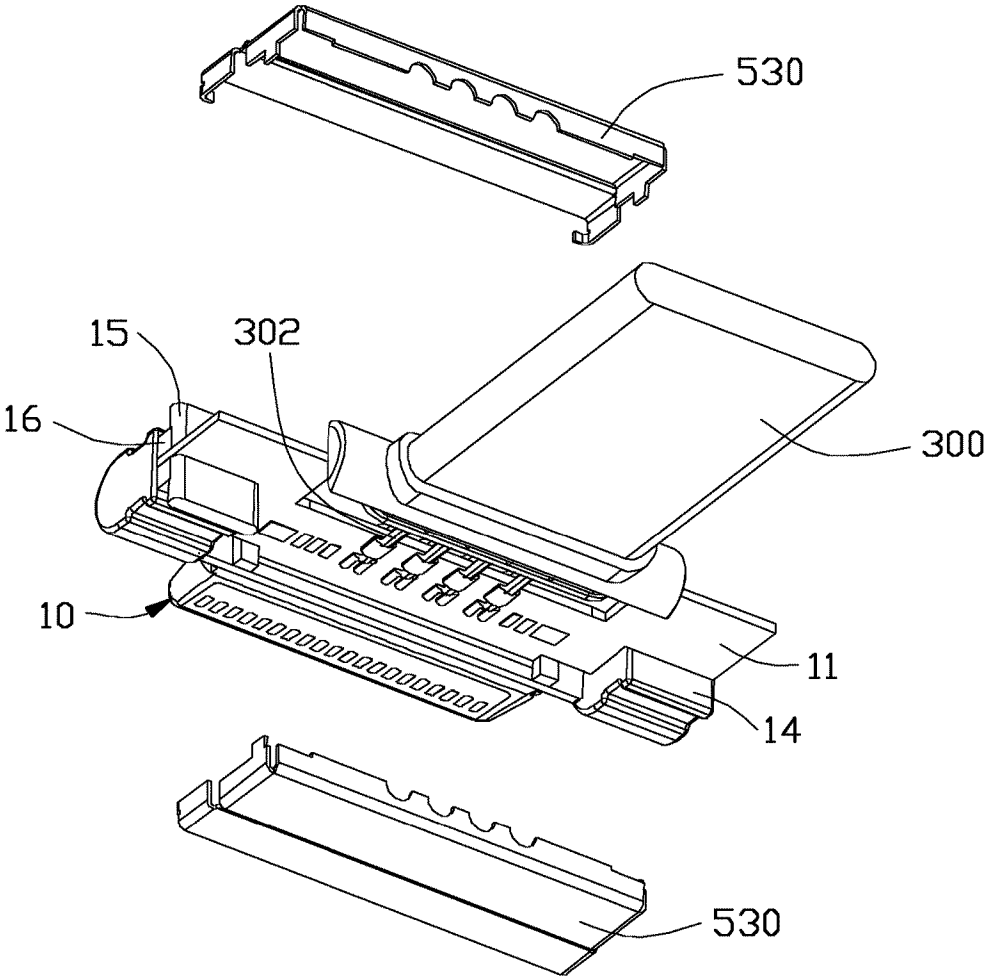
FIG. 8 is another perspective view of the contact module of FIG. 6.
Figure 9:
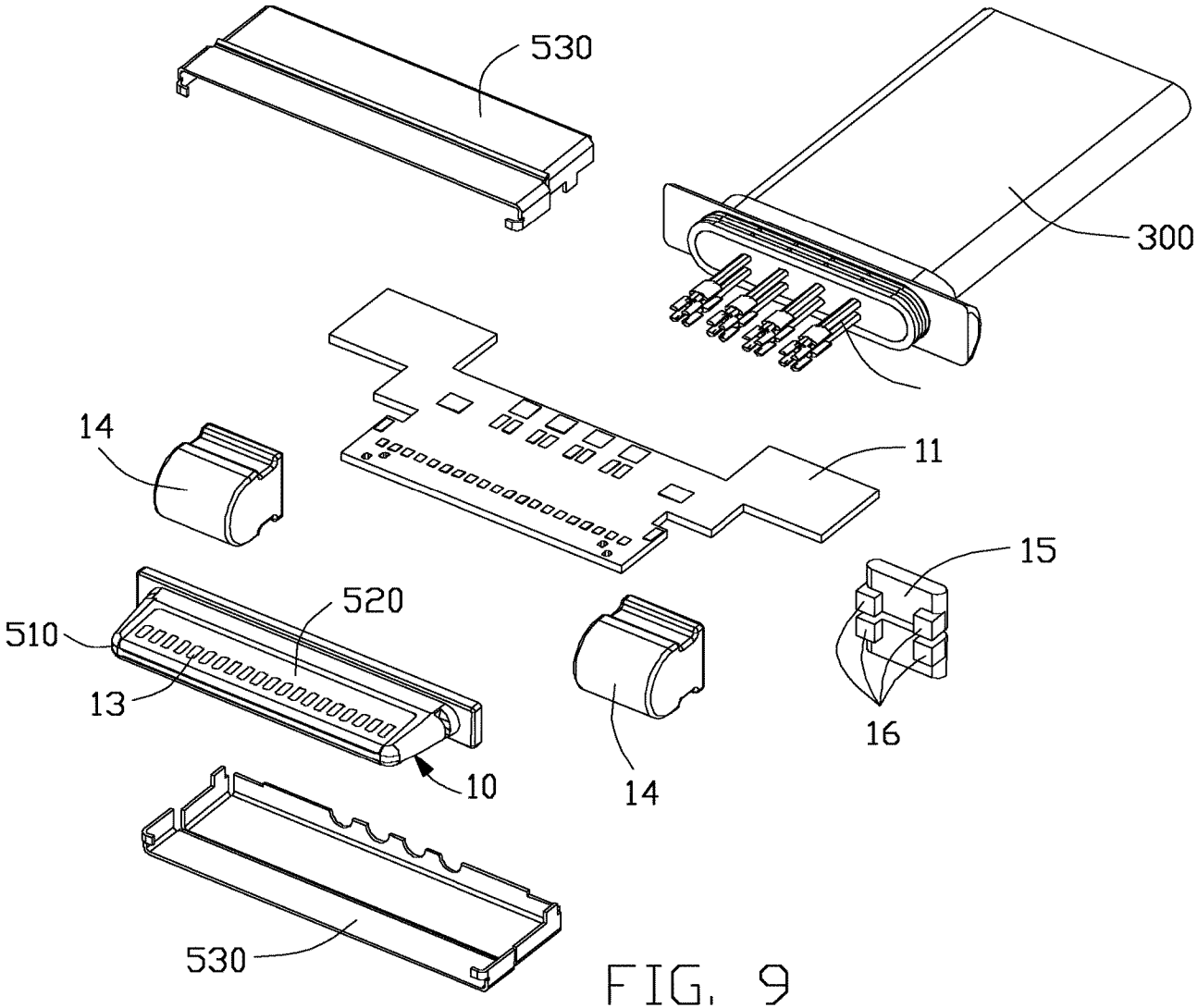
FIG. 9 is a further exploded perspective view of the contact module of FIG. 8.
Figure 10:
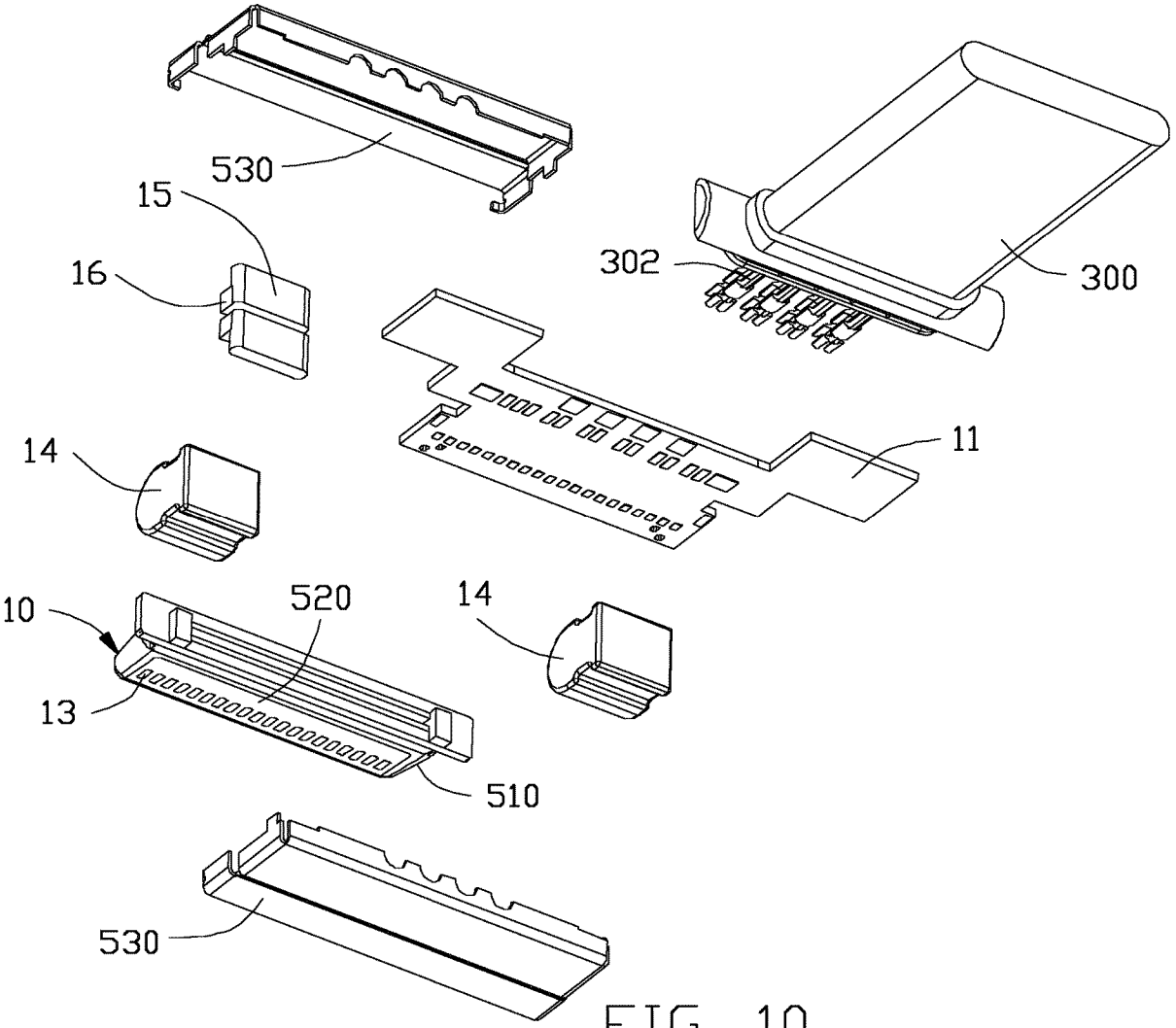
FIG. 10 is another exploded perspective view of the contact module of FIG. 9.
Figure 11:
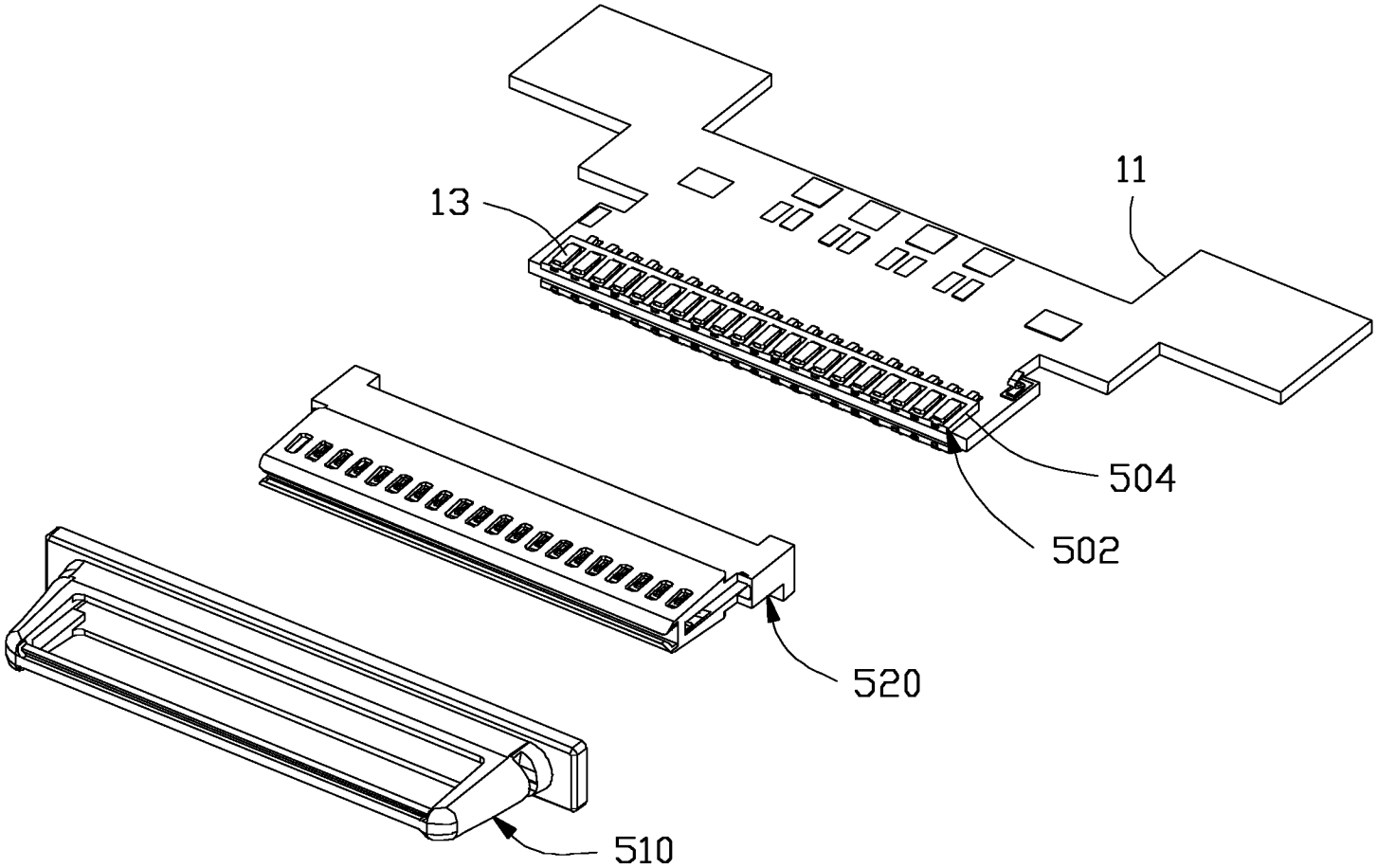
FIG. 11 is a further exploded perspective view of the contact module without the shield and the magnetic and the light guide of FIG. 9.
Figure 12:
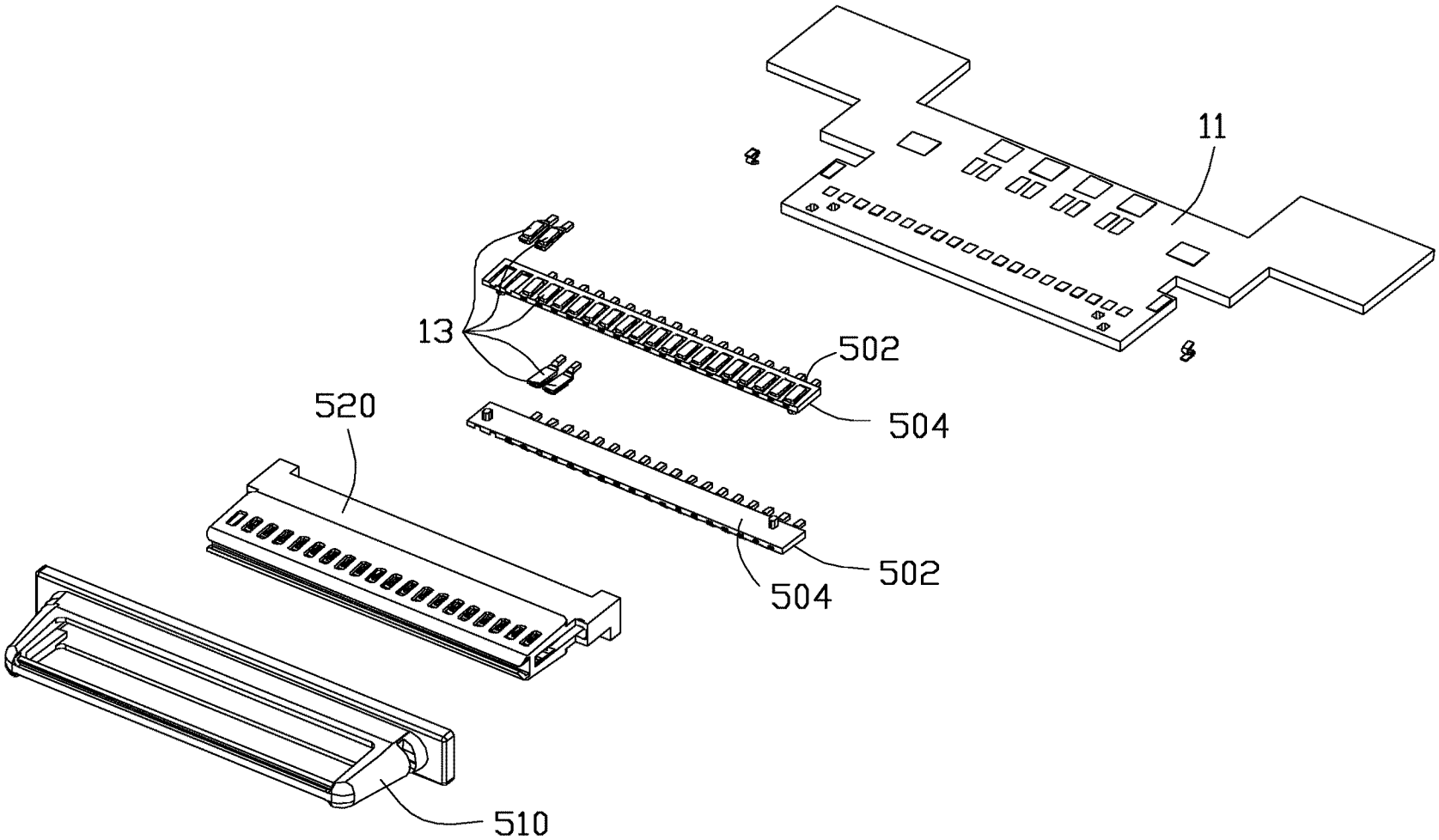
FIG. 12 is a further exploded perspective view of the contact module of FIG. 11.
Figure 13:
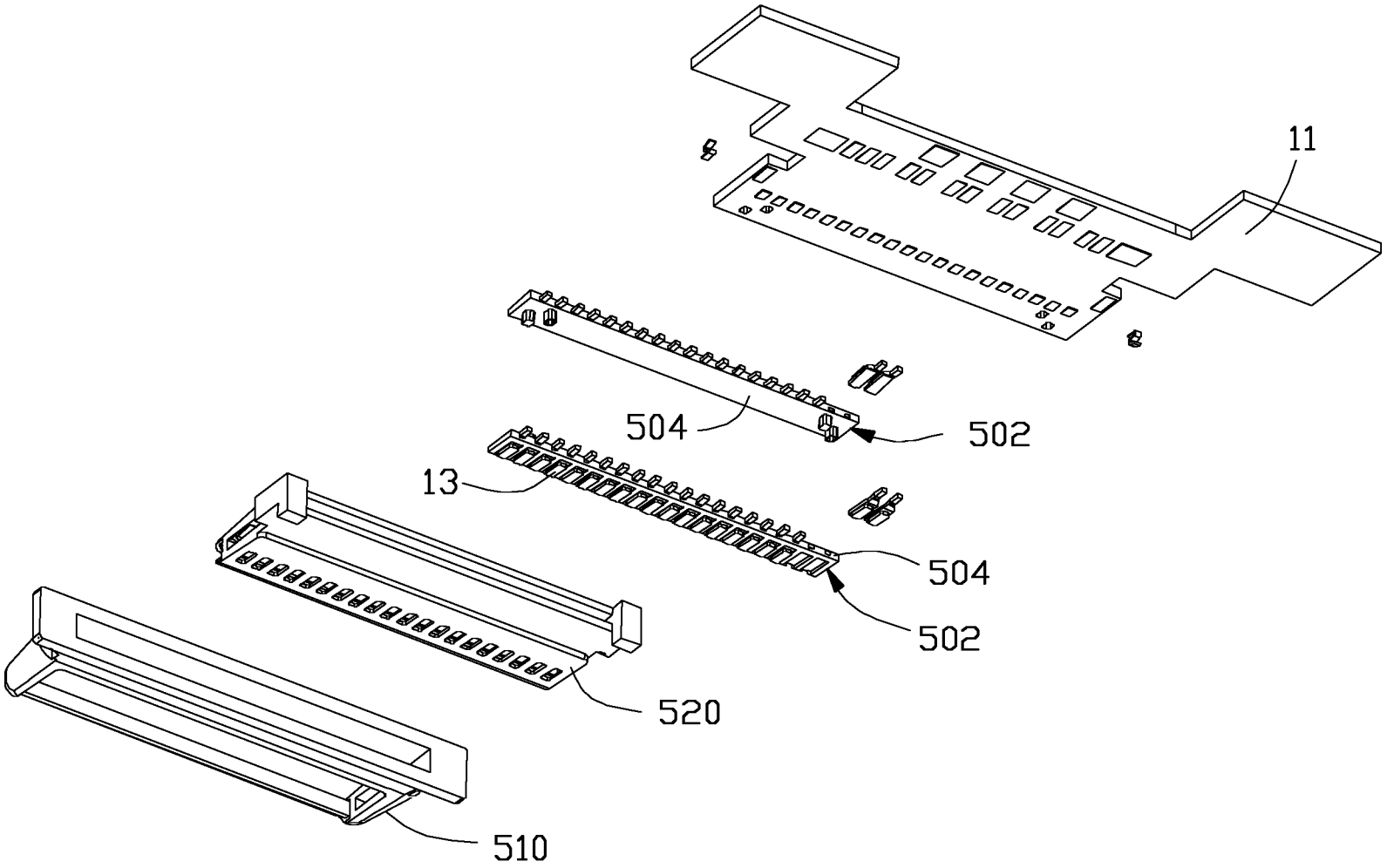
FIG. 13 is another exploded perspective view of the contact module of FIG. 12.
Figure 14:
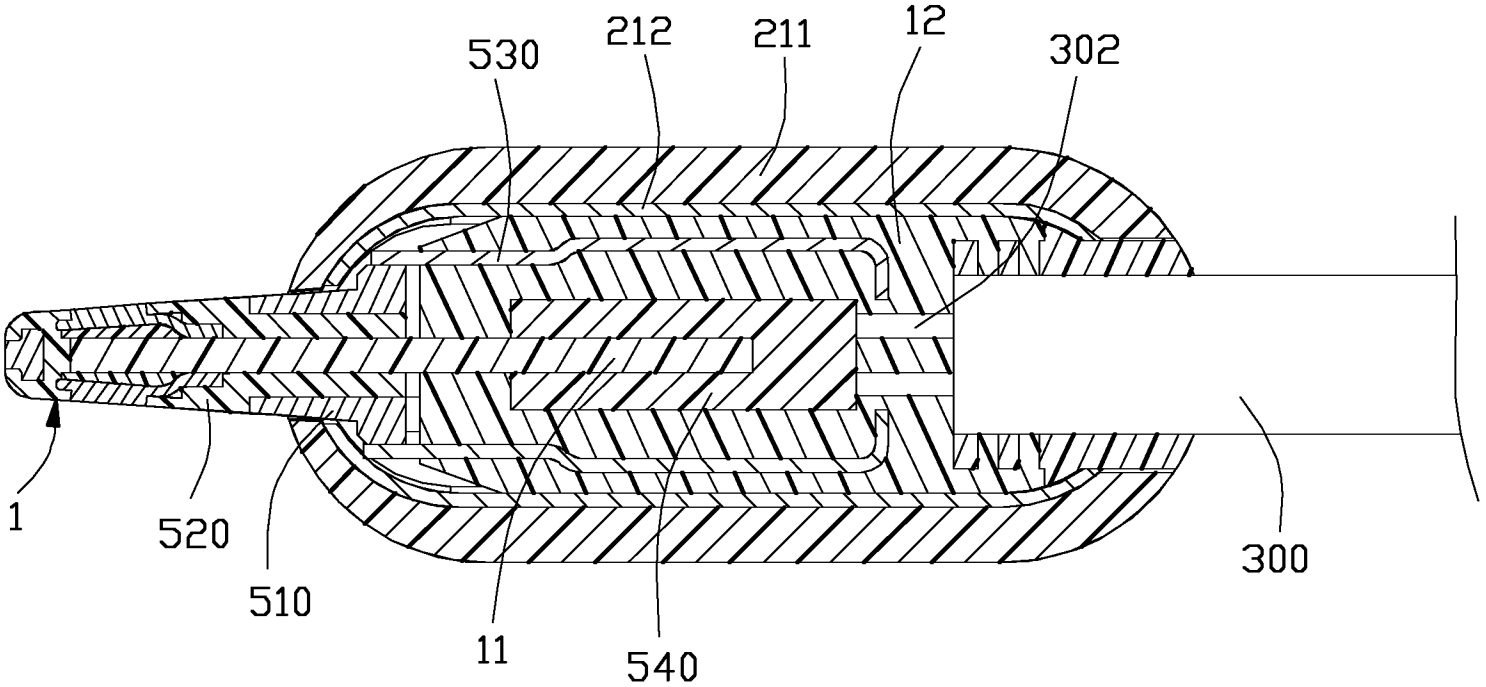
FIG. 14 a cross-sectional view of the cable connector assembly of FIG. 1.

FIGS. 5-14 show the detailed structure of the contact module 1 with the associated cable which is similar to the structures shown in U.S. Pat. No. 9,257,801. The contact module 1 includes a printed circuit board 11 with a front region on which the contact set 502 including the contacts 13 and the associated insulator 504, is mechanically and electrically mounted, and a rear region on which the wires 302 of the cable 300 are soldered. The front region of the printed circuit board 11 including the contact sets 502 is received within a metallic enclosure 510 and an insulative filling 520 is applied between the enclosure 510 and the printed circuit board 11 to retain the enclosure 510 with regard to the printed circuit board 11 so as to form the tongue 10. An inner molding 540 is applied upon the rear region of the printed circuit board 11 to protect the A pair of shields 530 commonly cover the inner molding 540, and the filling portion 12 encloses the pair of shields 530 and further invades a space between the shields 530 and the inner molding 540 and the associated printed circuit board 11.

The shell 2 includes base 21 extending in a transverse direction and a pair of side covers 22, 23 assembled to two sides of the base 21 in the transverse direction. The base 21 is in a cylindrical shape except the opening 213, the base 21 including an insulating layer 211, shield layer 212 assembled in the insulating layer 211 and a pair of cavities 214 formed at two sides thereof, the side cover 22 including an insulating layer 221 and shield layer 222 assembled in the insulating layer 221, the side cover 22 also including an insulating layer 231 and shield layer 232 assembled in the insulating layer 231. Therefore, when the base 21 is sealed by the side cover 22,23 from the two sides thereof, the shielding layer 212,222,232 on the base 21 and the side cover 22,23 form a better shielding space surrounding the contact module 1. Said shield layer 212 of the base 21 defines a slot 2121 for accommodating said light guiding member 15, and said insulating layer 212 is made of transparent material and covering said slot 2121 for displaying light from the luminous element 16 guided by said light guiding member 15.

The side cover 23 includes a vertical portion 2211 engaging with one side of the respective cavity 214, and a part of closed portion 223 transversely extending from the vertical portion 2211 and toward the tongue 10 to seal one side of the opening 213 except for exposure of the tongue 10. The side cover 23 includes a vertical portion 2311 engaging with other side of the respective cavity 214, and a part of closed portion 233 transversely extending from the vertical portion 2311 and toward the tongue 10 to seal other side of the opening 213 except for exposure of the tongue 10. In other words, the closed part 223 and the closed part 233 extend from the opening 213 of the two ends of the base 21 to the position of the tongue 10 of the contact module 1 to seal the opening 213 of two sides of the tongue 10.

In this embodiment, all the shielding layer 212,222,232 is made from metal sheets, and the insulating layer 211,221, 231 is formed from insulating material. The base 21 is inserted into insulating layer 211 by a manual shield layer 212 to get, the side cover 22 is inserted into insulating layer 221 by a manual shield layer 222 to get, and the side cover 23 is inserted into insulating layer 231 by a manual shield layer 232 to get, therefore, the shielding layer 212,222,232 is assembled to inside of the insulating layer. Obviously, in another preferred embodiment, the insulating layer 211,221, 231 may be injected molding with the shielding layer 212,222,232 made from metal sheets also could achieve the same shielding effect.

In this embodiment, the cable 300 is welded on the back-end of the printed circuit board 11, preferably, the end of cable 300 also cladding a stress relief member (unnumbered), which could fill the gap around the cable 300 in the hole 210, so that the cable connector assembly 1000 has a better shielding appearance.

The feature of the invention is to provide the specific shell upon the contact module 1 and the cable 300 and the corresponding assembling process as follows in the following sequence. Before the contact module 100 is assembled with the cable 300, the shell 2 is firstly loosely pre-assembled with the cable 300 through the hole 210 to expose the front end of the cable 300. The printed circuit board 11 and the enclosure 510, the contact set 502 and the insulative filling 520 associated therewith on the front region, is assembled to cable 300 by soldering the wires 302 upon the rear region of the printed circuit board 11. The inner molding 540 is applied upon the rear region to protect the connection between the wires 302 and the printed circuit board 11. The pair of shields 530 are assembled upon the enclosure 510. The filling portion 12 is molded upon the shields 530, the cable 300, the printed circuit board 11 and the inner molding 540. The shell 2 is successively moved forwardly in the front-to-back direction to have the opening 213, via flexibility/expandability thereof in the vertical direction perpendicular to both the transverse direction and the front-to-back direction, pass over the shell 2 and have the tongue 10 extend forwardly therefrom. The supporting portions 14 and the light guiding member 15 are assembled into two opposite ends of the interior of the base 21 and by two sides of the printed circuit board 11. The side covers 22 and 23 are assembled to the base 21 to seal the interior of the base 21. Eventually, the cable connector assembly has the tongue 10 and the cable 300 extend outwardly from two sides/ends of the shell 2 along the front-to-back direction, i.e., along the front-to-back line.

While a preferred embodiment of the present invention has been shown and described, equivalent modifications and changes known to persons skilled in the art according to the spirit of the present invention are considered within the scope of the present invention as described in the appended claims.

What is claimed is:

1. A cable connector assembly comprising:

a connector having a contact module and a shell installed at the outside of the contact module, the shell including a tubular base extending in a transverse direction and a pair of side covers assembled to two sides of the base in the transverse direction;

a cable connecting to said contact module;

wherein each of the base and side covers includes an insulating layer and a shield layer, the shield layers of the base and the side covers form a shield space surrounding the contact module; wherein the contact module also includes a filling portion made from insulative material, and said filling portion is applied further upon a front portion of the cable.

2. The cable connector assembly as claimed in claim 1, wherein the base defines an opening facing forwardly and running through said base in said transverse direction for said contact module forwardly extending through.

3. The cable connector assembly as claimed in claim 2, wherein base defines a pair of cavities formed at two sides thereof, the contact module includes a tongue forwardly extending out of the opening of the base; and each side cover includes a vertical portion engaging with the respective cavity, and a closed portion transversely extending from the vertical portion and toward the tongue to seal the opening except for exposure of the tongue.

4. The cable connector assembly as claimed in claim 1, wherein the shielding layer is made from metal sheets, and the insulating layer is formed from insulating material and injected molding with the shielding layer.

5. The cable connector assembly as claimed in claim 1, wherein the shielding layer is made from metal sheets and assembled to inside of the insulating layer.

6. The cable connector assembly as claimed in claim 1, wherein the base of the shell defines a hole facing backwardly for the cable passing through.

7. The cable connector assembly as claimed in claim 1, wherein the contact module also includes a printed circuit board disposed horizontally and a plurality of conductive contacts installed in the front of the printed circuit board, the cable is soldered to the printed circuit board.

8. The cable connector assembly as claimed in claim 7, wherein the contact module also includes a pair of supporting portions fixed on the printed circuit board and locating at two sides of the contact module for internally sustaining the shell.

9. The cable connector assembly as claimed in claim 7, wherein further includes a luminous element mounted to the printed circuit board and light guiding member assembled together with said luminous element.

10. The cable connector assembly as claimed in claim 9, wherein said shield layer of the base defines a slot for accommodating said light guiding member, and said insulating layer is made of transparent material and covering said slot for displaying light from the luminous element guided by said light guiding member.

11. A cable connector assembly comprising:

a pre-assembled contact module including a printed circuit board and a tongue located in front of the printed circuit board in a front-to-back direction;

a tubular shell extending along a transverse direction perpendicular to said front-to-back direction, and defining a hole through which a cable connected to the printed circuit board extends rearwardly in said front-to-back direction, an opening which is located opposite to the hole in said front-to-back direction and through which the tongue extends forwardly in the front-to-back direction; wherein before finally assembled, said opening extends through the shell in the transverse direction to be expandable in a vertical direction perpendicular to both said front-to-back direction and said transverse direction so as to allow the shell to move forwardly in the front-to-back direction and to have said opening pass over a filling portion which is applied upon the printed circuit board and located behind the tongue, for completing the whole cable connector assembly; wherein said filling portion is applied further upon a front portion of the cable.

12. The cable connector assembly as claimed in claim 11, wherein said shell includes a tubular base with two open ends, and two side covers sealing said two open ends of said base in the transverse direction.

13. The cable connector assembly as claimed in claim 12, wherein each of said two open ends is dimensioned to have a magnetic supporting portion and a light guide inserted into an interior of said base in said transverse direction, said supporting portions and the light guide are located by two sides of the printed circuit board viewed along the front-to-back direction.

14. The cable connector assembly as claimed in claim 11, wherein said shell includes an outer insulative layer and an inner metallic layer.

15. The cable connector assembly as claimed in claim 11, wherein the filling portion shell intimately outwardly contact the shell to provide support thereon.

16. A method for making a cable connector assembly comprising steps of: providing a contact module with a front tongue and a rear printed circuit board along a front-to-back direction;

connecting a cable to the printed circuit board;

providing a tubular shell extending along a transverse direction, which is perpendicular to said front-to-back direction, with a hole through which the cable rearwardly extends, and an opening located opposite to the hole in the front-to-back direction and expandable in a vertical direction perpendicular to both said front-to-back direction and said transverse direction; wherein said shell is firstly pre-assembled to the cable through said opening, and the contact module is successively assembled to the cable by soldering wires of the cable to the printed circuit board, and finally the shell is forwardly moved toward the tongue to have the rear printed circuit board located within an interior space of the tubular shell while the front tongue is forwardly exposed to an exterior, wherein said tubular shell forms two opposite open ends in said transverse direction, and a pair of magnetic supporting portions and at least one light guide are inserted into the interior space through said open ends and located by two sides of the printed circuit board.

17. The method as claimed in claim 16; further including a step of forming an filling portion upon the printed circuit board to outwardly support the shell; wherein said opening is expanded outwardly in the vertical direction to pass over said filling portion when the shell is forwardly moved toward the tongue in said front-to-back direction.

18. The method as claimed in claim 16, wherein said shell includes an outer insulative layer and the inner metallic layer.

* * * * *